US011185960B2

(12) United States Patent
Lee

(10) Patent No.: US 11,185,960 B2
(45) Date of Patent: Nov. 30, 2021

(54) POSITIONING STRUCTURE OF CLAMPER OF THREADING MACHINE FOR RACKET

(71) Applicant: Min Wei Lee, Taichung (TW)

(72) Inventor: Min Wei Lee, Taichung (TW)

( * ) Notice: Subject to any disclaimer, the term of this patent is extended or adjusted under 35 U.S.C. 154(b) by 175 days.

(21) Appl. No.: 16/731,153

(22) Filed: Dec. 31, 2019

(65) Prior Publication Data

US 2021/0197344 A1 Jul. 1, 2021

(51) Int. Cl.

| | |
|---|---|
| ***B25B 1/16*** | (2006.01) |
| ***B25B 1/24*** | (2006.01) |
| ***B25B 1/02*** | (2006.01) |
| ***A63B 51/14*** | (2006.01) |

(52) U.S. Cl.
CPC ..... *B25B 1/16* (2013.01); *B25B 1/02* (2013.01); *B25B 1/2489* (2013.01); *A63B 51/14* (2013.01)

(58) Field of Classification Search
CPC ..... B25B 1/16; B25B 1/02; A63B 49/00; A63B 51/14
See application file for complete search history.

(56) References Cited

U.S. PATENT DOCUMENTS 5,090,697 A * 2/1992 Lee ..... A63B 51/16 473/555
6,533,687 B1 * 3/2003 Lee ..... A63B 51/14 473/557
6,764,418 B1 * 7/2004 Lee ..... A63B 51/14 473/557
7,144,342 B1 * 12/2006 Van Der Pols ..... A63B 51/14 473/557
7,252,606 B1 * 8/2007 Lee ..... A63B 49/025 473/557
7,485,055 B1 * 2/2009 Lee ..... A63B 51/14 473/557
8,206,249 B1 * 6/2012 Wise ..... A63B 51/14 473/557
8,303,440 B1 * 11/2012 Lee ..... A63B 51/14 473/555
9,908,009 B1 * 3/2018 Lee ..... A63B 51/14
2001/0037546 A1 * 11/2001 Tsuchida ..... A63B 51/16 29/241
2007/0275798 A1 * 11/2007 Brunner ..... A63B 47/008 473/553
2014/0315668 A1 * 10/2014 Zdrazila ..... A63B 51/14 473/556

(Continued)

*Primary Examiner* — Eugene L Kim
*Assistant Examiner* — Christopher Glenn

(57) ABSTRACT

A positioning structure of a clamper of a threading machine for a racket contains: a rack, an engagement protrusion, an operation member, and two springs. A fixing holder is erected on a support plate of the threading machine, and the rack includes multiple first teeth, the fixing holder includes an accommodation chamber with an opening. The engagement protrusion is received in the accommodation chamber and includes a toothed extension on which multiple second teeth are formed. The engagement protrusion further includes a recess and an abutting fence. The operation member includes a drive portion and a push portion. The two springs are mounted on a top of the engagement protrusion, and two ends of each spring abut against the engagement protrusion and the fixing holder respectively so that each spring forces the engagement protrusion to engage with the rack.

8 Claims, 4 Drawing Sheets

(56) References Cited

U.S. PATENT DOCUMENTS

| | | | | |
|---|---|---|---|---|
| 2016/0121176 | A1* | 5/2016 | Cerf | A63B 51/14 473/557 |
| 2019/0366161 | A1* | 12/2019 | Lin | A63B 51/14 |

* cited by examiner

POSITIONING STRUCTURE OF CLAMPER OF THREADING MACHINE FOR RACKET

FIELD OF THE INVENTION

The present invention relates to a clamper of a threading machine for a racket, and more particularly to a positioning structure of a clamper of a threading machine for a racket.

BACKGROUND OF THE INVENTION

A conventional tennis racket and a badminton racket contains a head frame fixed on a top thereof, and multiple strings are intersected and fixed inside the head frame so as to form a batting surface. A tension of the batting surface depends on the security of the multiple strings, so the multiple strings are intersected and fixed inside the head frame by ways of a threading machine for a racket.

The threading machine contains multiple clampers arranged on a top of a support plate and configured to fix a head frame, such that the strings are inserted into the head frame securely.

When desiring to insert the strings into different sizes of head frames of the tennis racket and the badminton racket in order, the multiple clampers are moved away from one another so that the head frame of the tennis racket is fixed by the multiple clampers. In contrast, when inserting the strings into the tennis racket, the multiple clampers are moved close to one another so as to fix the head frame. Thus, it is necessary to change a distance among the multiple clampers.

A positioning structure of a clamper of a threading machine for a racket is disclosed in TW Patent No. M426421 and contains a rack, a defining element, and an operation member.

The rack is engaged on the support plate of the threading machine, multiple ratchets arranged on a top of the racket, multiple clampers mounted on a top of the support plate. The defining element is movably received inside the multiple clampers, a bottom of the defining element is obliquely engaged with the multiple ratchets of the rack, such that when pushing the multiple clampers to the support plate, the defining element moves across the multiple ratchets, and the multiple clampers cannot move to the support plate. In addition, when user touches the multiple clampers during inserting the strings, the multiple clampers move to the support plate easily.

The present invention has arisen to mitigate and/or obviate the afore-described disadvantages.

SUMMARY OF THE INVENTION

The primary objective of the present invention is to provide a positioning structure of a clamper of a threading machine for a racket in which the engagement protrusion engages with the rack to enhance a security of the clamper of the threading machine.

To obtain the above objective, a positioning structure of a clamper of a threading machine for a racket provided by the present invention contains: a rack, an engagement protrusion, an operation member, and two springs.

The fixing holder is erected on a top of a support plate of the threading machine, and the rack is engaged on the support plate, the rack includes multiple first teeth extending from a top of the rack, the fixing holder includes an accommodation chamber defined in the fixing holder and communicating with the rack, and the accommodation chamber has an opening formed on a side of the fixing holder.

The engagement protrusion is received in the accommodation chamber and includes a toothed extension on which multiple second teeth are formed, wherein the toothed extension is parallel to the rack, such that the engagement protrusion engages with the rack by ways of the toothed extension, the engagement protrusion includes a recess defined adjacent to the opening and includes an abutting fence formed on a top of the recess.

The operation member is rotatably connected with the fixing holder, and the operation member includes a drive portion and a push portion, wherein a rotary shaft is inserted through the operation member and two ends of the rotary shaft are connected with the fixing holder, such that the operation member is rotated along the rotary shaft.

A first end of the push portion is obliquely connected with the drive portion, and the push portion partially extends out of the accommodation chamber via the opening, a second end of the push portion extends into the recess and is proximate to the abutting fence, such that the push portion pushes the engagement protrusion upward so that the engagement protrusion disengages from the rack.

The two springs are mounted on a top of the engagement protrusion, and two ends of each spring abut against the engagement protrusion and the fixing holder respectively so that each spring forces the engagement protrusion to engage with the rack.

DETAILED DESCRIPTION OF THE PREFERRED EMBODIMENTS

Figure 1:
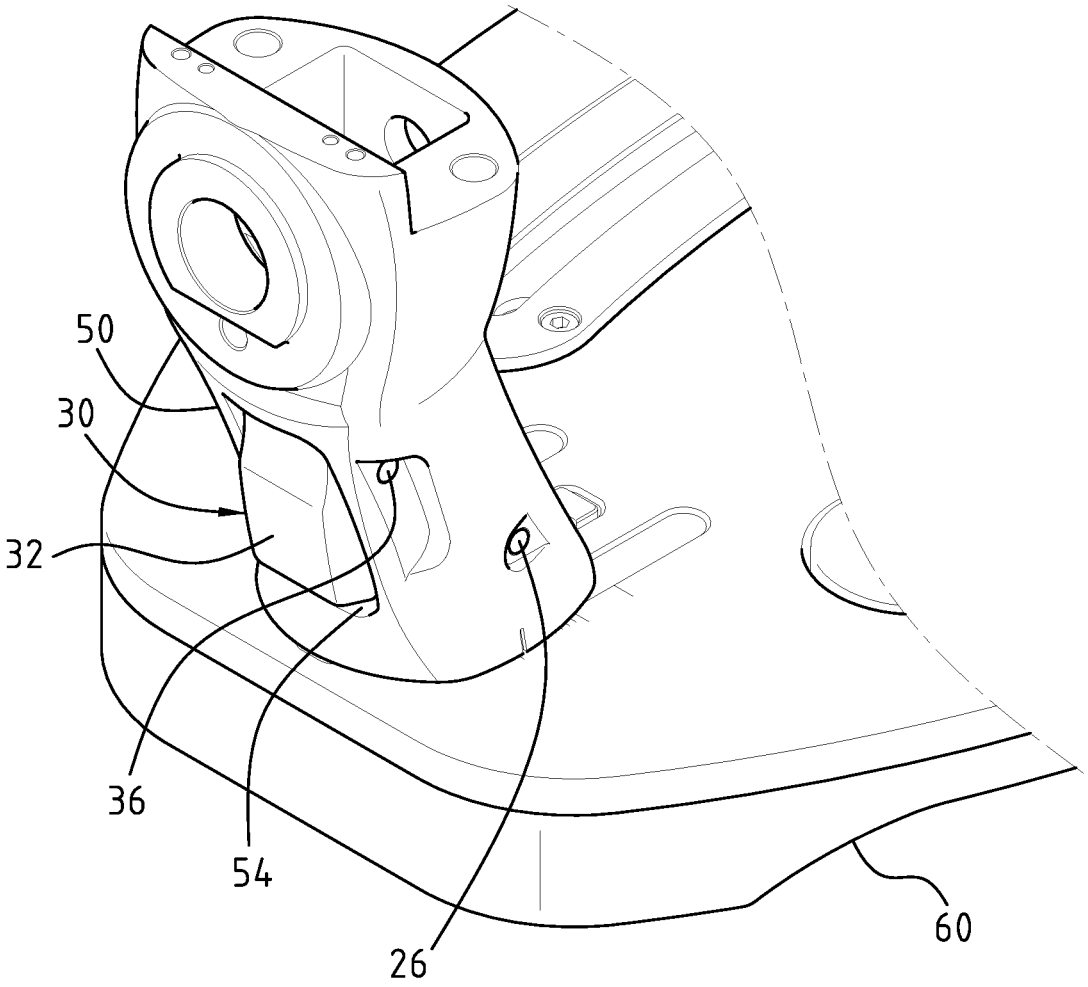
FIG. 1 is a perspective view showing the assembly of a positioning structure of a clamper of a threading machine for a racket according to a preferred embodiment of the present invention.
Figure 2:
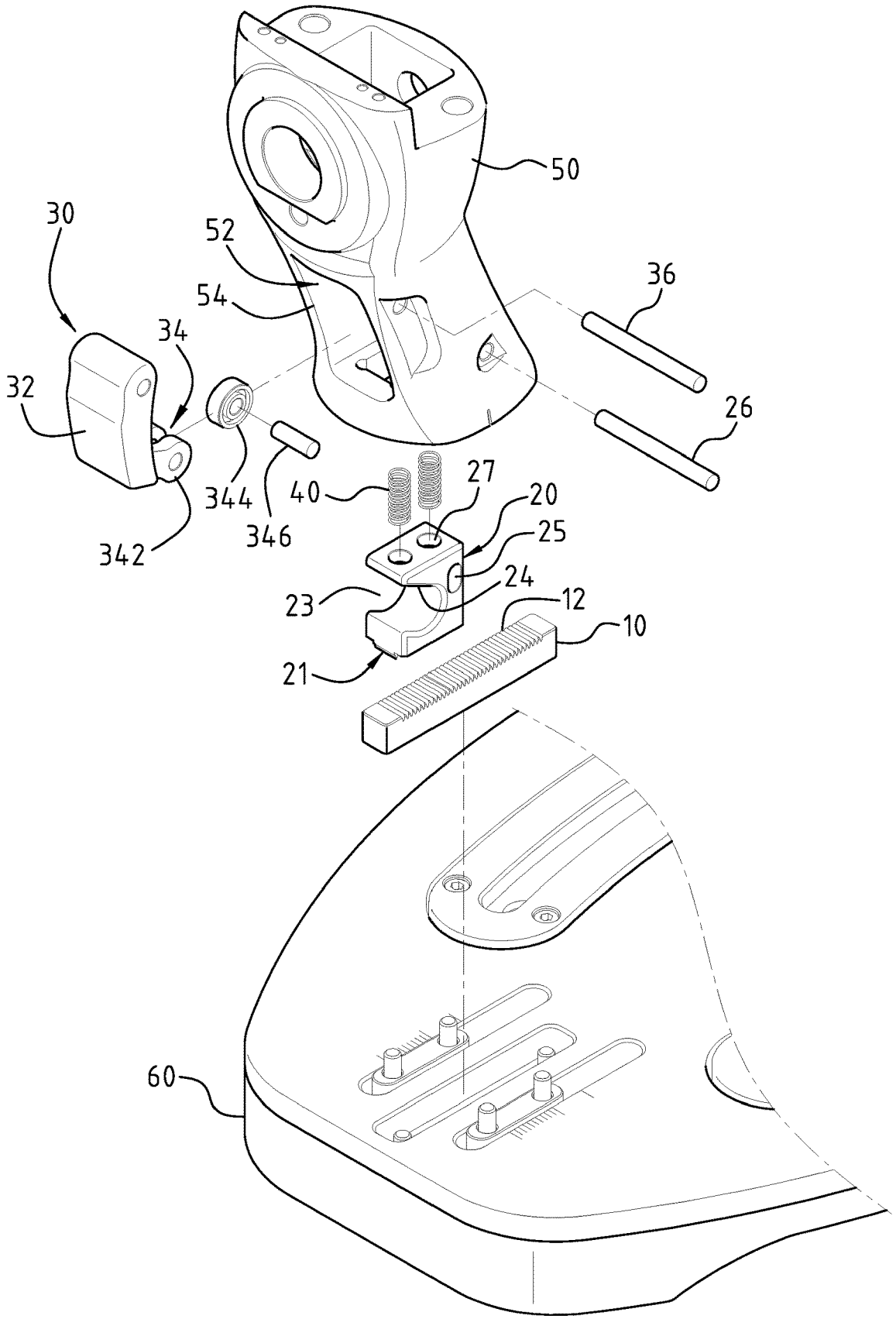
FIG. 2 is a perspective view showing the exploded components of the positioning structure of the clamper of the threading machine for the racket according to the preferred embodiment of the present invention.
Figure 3:
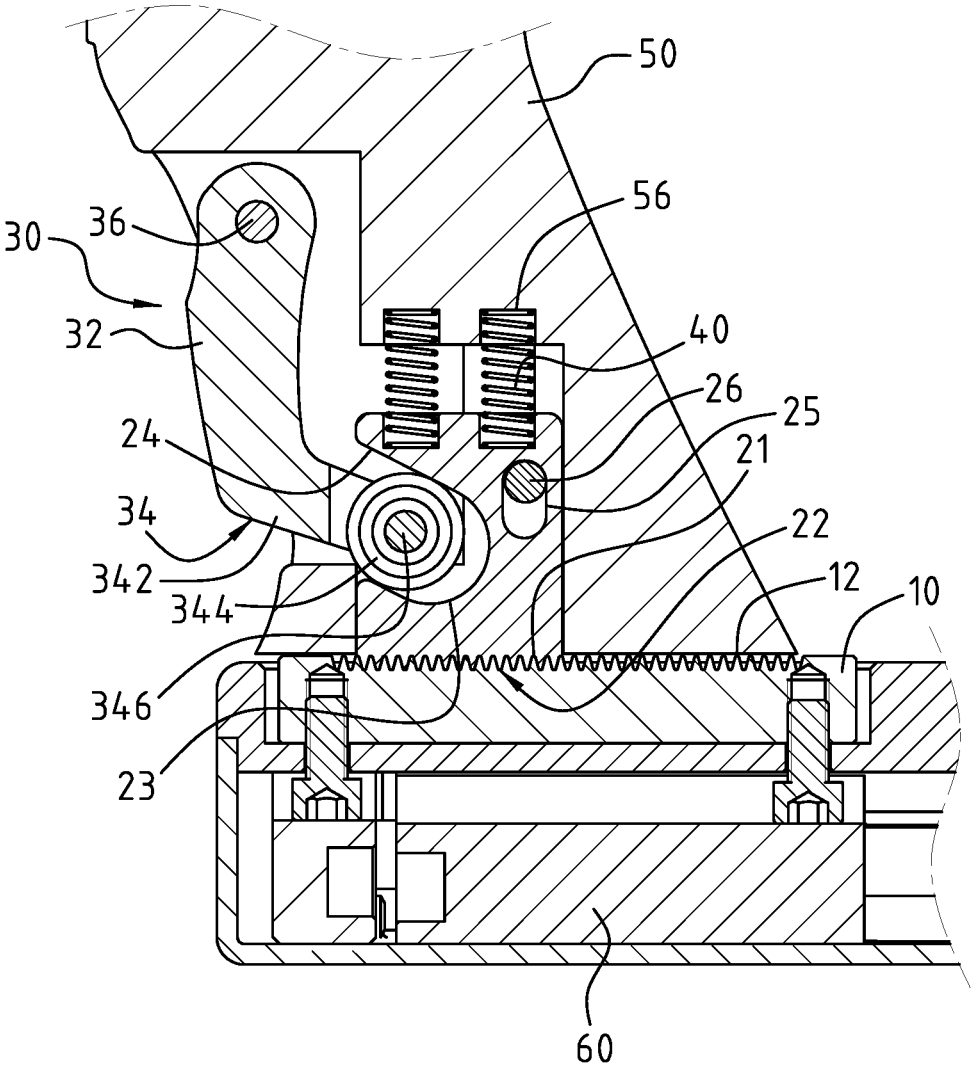
FIG. 3 is a cross sectional view showing the assembly of the positioning structure of the clamper of the threading machine for the racket according to the preferred embodiment of the present invention.

With reference to FIGS. 1-4, a positioning structure of a clamper of a threading machine for a racket according to a preferred embodiment of the present invention comprises: a rack 10, an engagement protrusion 20, an operation member 30, and two springs 40. A fixing holder 50 is erected on a top of a support plate 60 of the threading machine, and the rack 10 is engaged on the support plate 60. The rack 10 includes multiple first teeth 12 extending from a top thereof, the fixing holder 50 includes an accommodation chamber 52 defined therein and communicating with the rack 10, and the accommodation chamber 52 has an opening 54 formed on a side of the fixing holder 50.

The engagement protrusion 20 is received in the accommodation chamber 52 and includes a toothed extension 22 on which multiple second teeth 21 are formed, wherein the toothed extension 22 is parallel to the rack 10, such that the engagement protrusion 20 engages with the rack 10 by ways of the toothed extension 22. The engagement protrusion 20 includes a recess 23 defined adjacent to the opening 54 and includes an abutting fence 24 formed on a top of the recess 23. The operation member 30 is rotatably connected with the fixing holder 50, and the operation member 30 includes a drive portion 32 and a push portion 34, wherein a rotary shaft 36 is inserted through the operation member 30 and two ends of the rotary shaft 36 are connected with the fixing holder 50, such that the operation member 30 is rotated along the rotary shaft 36. A first end of the push portion 34 is obliquely connected with the drive portion 32, and the push portion 34 partially extends out of the accommodation chamber 52 via the opening 54. A second end of the push portion 34 extends into the recess 23 and is proximate to the abutting fence 24 such that the push portion 34 pushes the engagement protrusion 20 upward so that the engagement protrusion 20 disengages from the rack 10. The two springs 40 are mounted on a top of the engagement protrusion 20, and two ends of each spring 40 abut against the engagement protrusion 20 and the fixing holder 50 respectively so that each spring 40 forces the engagement protrusion 20 to engage with the rack 10.

When the fixing holder 50 is fixed on the support plate 60, each spring 40 urges the engagement protrusion 20 to move downward and to engage with the rack 10. In the meantime, the multiple second teeth 21 engage with the multiple first teeth 12 respectively so that the fixing holder 50 is not pushed and moves on the top of the support plate 60.

Figure 4:
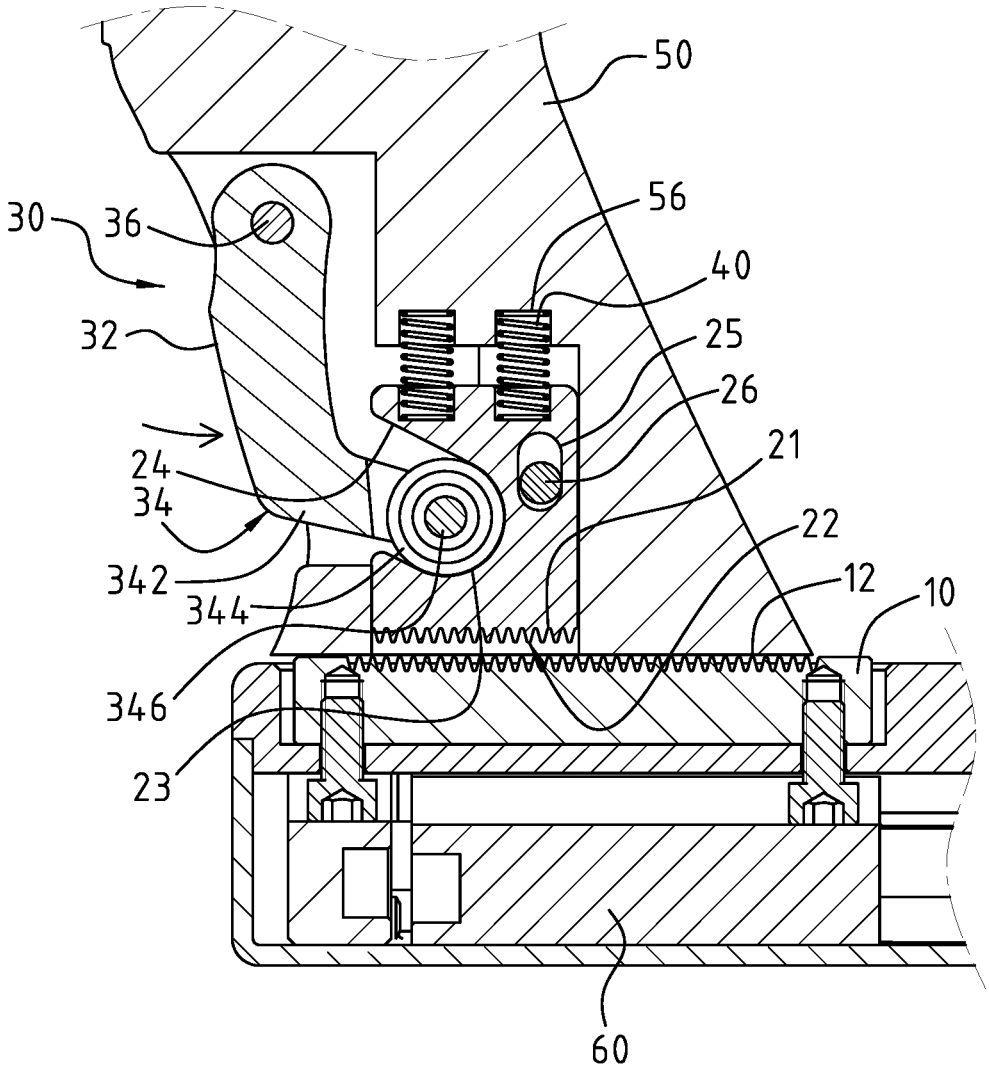
FIG. 4 is another cross sectional view showing the operation of the positioning structure of the clamper of the threading machine for the racket according to the preferred embodiment of the present invention.

When the drive portion 32 is pressed inward with respective to the accommodation chamber 52, the operation member 30 rotates counterclockwise, and the push portion 34 pushes the abutting fence 24 upward so as to move the engagement protrusion 20 upward (as shown in FIG. 4), hence the engagement protrusion 20 disengages from the rack 10 so as to move the fixing holder 50 on the top of the support plate 60.

Accordingly, the engagement protrusion 20 engages with the rack 10 to enhance a security of the clamper of the threading machine.

The push portion 34 has two opposite arms 342 and a roller 344, wherein a first end of each arm 342 is obliquely connected with the drive portion 32, and a second end of each arm 342 extends to the top of the recess 23. The roller 344 is defined between the two opposite arms 342 and is rotatably connected with a column 346 which is coupled with the two opposite arms 342 so that the roller 344 pushes the engagement protrusion 20 to move upward.

When the push portion 34 pushes the engagement protrusion 20 upward, the roller 344 rotatably contacts with the abutting fence 24 so as to reduce a friction between the roller 344 and the abutting fence 24. When the fixing holder 50 moves to a desired fixing position and the drive portion 32 is released, the engagement protrusion 20 is pushed by the two spring 40 to move downward, and the push portion 34 contacts with the abutting fence 24 by using the roller 344 to avoid an engagement between the abutting fence 24 and the push portion 34, and the engagement protrusion 20 does not move downward to disengage from the rack 10.

The engagement protrusion 20 further includes a slot 25, two ends of which face to the top of the engagement protrusion 20 and the rack 10 respectively, wherein a limitation post 26 is rotatably accommodated in the slot 25, and two ends of the limitation post 26 are in connection with the fixing holder 50 so that the limitation post 26 limits a movement of the engagement protrusion 20.

The engagement protrusion 20 further includes two first orifices 27 extending downward from the top of the engagement protrusion 20, and the fixing holder 50 further includes two second orifices 56 formed on a top of the accommodation chamber 52, wherein the two ends of each spring 40 are rotatably connected in the first orifice 27 and the second orifice 56 respectively so as to fix each spring 40.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A positioning structure of a clamper of a threading machine for a racket comprising: a rack, an engagement protrusion, an operation member, and two springs;

wherein a fixing holder is erected on a top of a support plate of the threading machine, and the rack is engaged on the support plate, the rack includes multiple first teeth extending from a top of the rack, the fixing holder includes an accommodation chamber defined in the fixing holder and communicating with the rack, and the accommodation chamber has an opening formed on a side of the fixing holder;

wherein the engagement protrusion is received in the accommodation chamber and includes a toothed extension on which multiple second teeth are formed, wherein the toothed extension is parallel to the rack, such that the engagement protrusion engages with the rack by ways of the toothed extension, the engagement protrusion includes a recess defined adjacent to the opening and includes an abutting fence formed on a top of the recess;

wherein the operation member is rotatably connected with the fixing holder, and the operation member includes a drive portion and a push portion, wherein a rotary shaft is inserted through the operation member and two ends of the rotary shaft are connected with the fixing holder, such that the operation member is rotated along the rotary shaft;

wherein a first end of the push portion is obliquely connected with the drive portion, and the push portion partially extends out of the accommodation chamber via the opening, a second end of the push portion extends into the recess and is proximate to the abutting fence, such that the push portion pushes the engagement protrusion upward so that the engagement protrusion disengages from the rack; and wherein the two springs are mounted on a top of the engagement protrusion, and two ends of each spring abut against the engagement protrusion and the fixing holder respectively so that each spring forces the engagement protrusion to engage with the rack.

2. The positioning structure as claimed in claim 1, wherein the push portion has two opposite arms and a roller, wherein a first end of each arm is obliquely connected with the drive portion, and a second end of each arm extends to the top of the recess, wherein the roller is defined between the two opposite arms and is rotatably connected with a column which is coupled with the two opposite arms so that the roller pushes the engagement protrusion to move upward.

3. The positioning structure as claimed in claim 1, wherein the engagement protrusion further includes a slot, two ends of which face to the top of the engagement protrusion and the rack respectively, and a limitation post is rotatably accommodated in the slot, and two ends of the limitation post are in connection with the fixing holder so that the limitation post limits a movement of the engagement protrusion.

4. The positioning structure as claimed in claim 2, wherein the engagement protrusion further includes a slot, two ends of which face to the top of the engagement protrusion and the rack respectively, and a limitation post is rotatably accommodated in the slot, and two ends of the limitation post are in connection with the fixing holder so that the limitation post limits a movement of the engagement protrusion.

5. The positioning structure as claimed in claim 1, wherein the push portion partially extends out of the accommodation chamber via the opening.

6. The positioning structure as claimed in claim 2, wherein the push portion partially extends out of the accommodation chamber via the opening.

7. The positioning structure as claimed in claim 1, wherein the engagement protrusion further includes two first orifices extending downward from the top of the engagement protrusion, and the fixing holder further includes two second orifices formed on a top of the accommodation chamber, wherein the two ends of each spring are rotatably connected in the first orifice and the second orifice respectively so as to fix each spring.

8. The positioning structure as claimed in claim 2, wherein the engagement protrusion further includes two first orifices extending downward from the top of the engagement protrusion, and the fixing holder further includes two second orifices formed on a top of the accommodation chamber, wherein the two ends of each spring are rotatably connected in the first orifice and the second orifice respectively so as to fix each spring.

* * * * *